US005194688A

United States Patent [19]

Piesik

[11] Patent Number: 5,194,688

[45] Date of Patent: Mar. 16, 1993

[54] APPARATUS FOR LIMITING RECIRCULATION OF ROCKET EXHAUST GASES DURING MISSILE LAUNCH

[75] Inventor: Edward T. Piesik, Pomona, Calif.

[73] Assignee: Hughes Missile Systems Company, Los Angeles, Calif.

[21] Appl. No.: 828,439

[22] Filed: Jan. 31, 1992

[51] Int. Cl.[5] ..... F41F 3/077

[52] U.S. Cl. ..... 89/1.816; 89/1.8; 89/1.812

[58] Field of Search ..... 89/1.816, 1.812, 1.8

[56] References Cited

U.S. PATENT DOCUMENTS

| | | | |
|---|---|---|---|
| 2,427,980 | 9/1947 | Stinson et al. | 244/42 |
| 2,679,467 | 5/1954 | Sherts | 154/2.73 |
| 4,173,919 | 11/1979 | Piesik | 89/1.816 |
| 4,324,167 | 4/1982 | Piesik | 89/1.812 |
| 4,373,420 | 2/1983 | Piesik | 89/1.812 |
| 4,498,261 | 2/1985 | Wilson et al. | 52/1 |
| 4,683,798 | 8/1987 | Piesik | 89/1.816 |
| 4,686,884 | 8/1987 | Piesik | 89/1.816 |

*Primary Examiner*—David H. Brown

*Attorney, Agent, or Firm*—C. D. Brown; R. M. Heald; W. K. Denson-Low

[57] ABSTRACT

A convoluted fan structure is provided along the bottom surface of each diagonal segment of a petal-formed aft cover for a missile canister. As the cover petals open under influence of rocket exhaust impingement on the cover, the fan structures cover the diagonal areas toward the corners of the opening. This prevents recirculation of rocket exhaust gases from the plenum into the canister through the formerly open corner areas and augment the closure force to restore the petals to the closed position after completion of missile launch.

11 Claims, 3 Drawing Sheets

UNFIRED CELL

PREVIOUSLY-FIRED CELL

FIG. 3
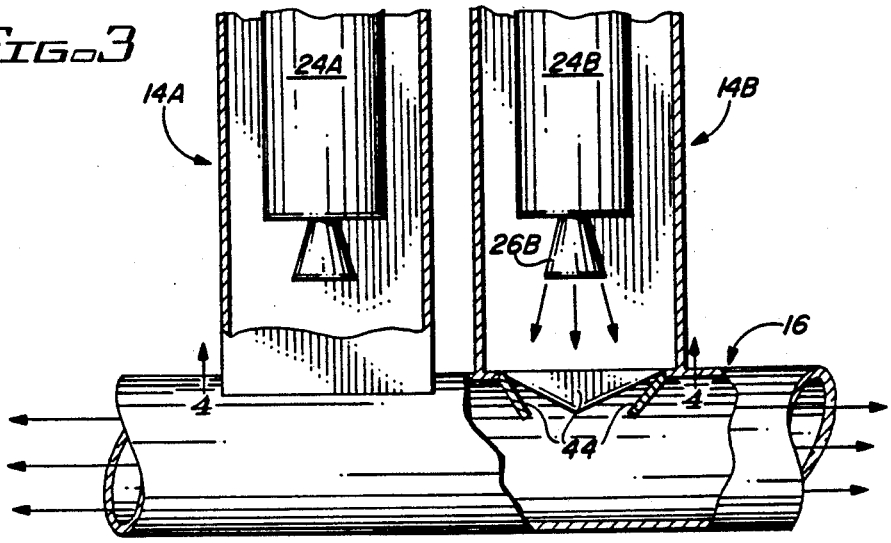
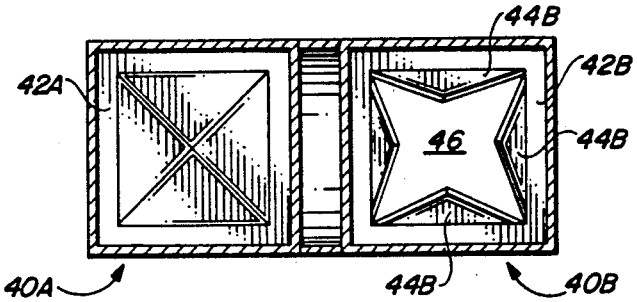
FIG. 4
FIG. 5
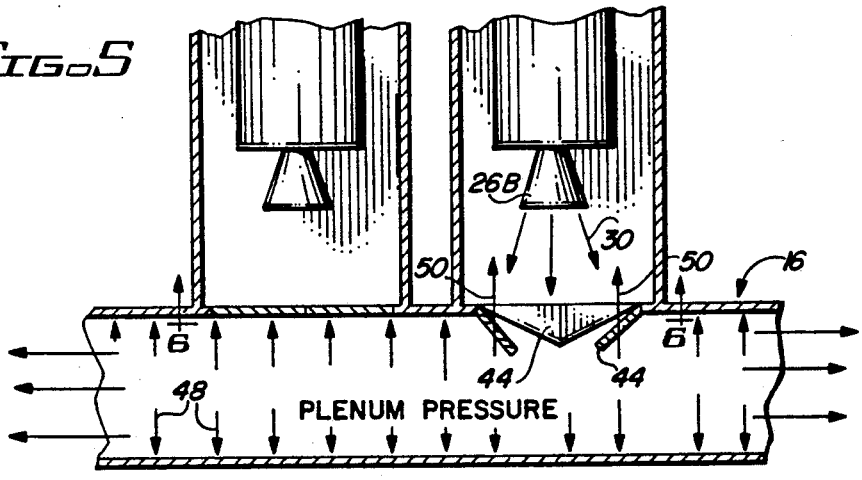
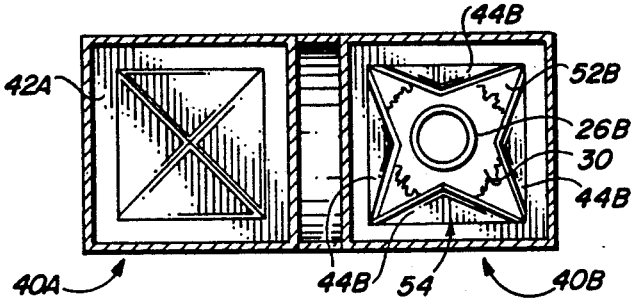
FIG. 6

APPARATUS FOR LIMITING RECIRCULATION OF ROCKET EXHAUST GASES DURING MISSILE LAUNCH

BACKGROUND OF THE INVENTION

1. Field of the Invention

The present invention relates to the field of controlled flow, exhaust manifold systems and, more particularly, to apparatus for controlling the flow of missile exhaust gases by preventing recirculation back into the cell of the fired missile from a common exhaust gas manifold or plenum tube connected thereto.

2. Description of the Related Art

In certain military applications, particularly on warships having missile firing capability, the missiles are stored in a series of vertically oriented chambers or cells closely adjacent one another. Exhaust gas outlets are normally provided to duct rocket exhaust gases generated during intended or accidental rocket ignitions to a safe location. In such installations, manifolding of a number of chambers into a common exhaust duct or plenum tube has become conventional.

There have been a number of approaches to the problems attendant upon the use of a common exhaust duct with a plurality of missile storage chambers. It is important to be able to block the exhaust gases from a missile which is being fired from blowing out through the individual chambers of other missiles. This is commonly accomplished by the use of doors or hinged panels which can open into the plenum chamber from the force of an impinging missile exhaust for the chamber containing the missile being fired and which can close off the passage at the base of a missile chamber opening into the exhaust plenum for other missiles.

Eastman U.S. Pat. No. 2,445,423 discloses apparatus having a plurality of individual missile chambers coupled to a common plenum chamber with a plurality of hinged, spring-loaded doors at the juncture of each individual missile chamber with the plenum tube. These doors open for a rocket that is being fired and serve to confine the exhaust gases within the plenum chamber and away from other missile-storage chambers.

There is also the problem of a portion of the rocket exhaust backing up into the chamber of the missile being fired and possibly over-pressurizing or over-heating that missile chamber.

My own prior U.S. Pat. No. 4,044,648, the entire disclosure of which is incorporated by reference as though fully set forth herein, discloses a pair of hinged doors at the base of each missile storage chamber in the passage connecting the chamber to an associated exhaust plenum duct. The pressure forces on opposite sides of the doors during the firing of a missile are balanced to control the degree to which the doors are opened in order to adjust the opening to the varying dimension of the rocket exhaust stream as the missile rises and leaves the chamber upon firing. As a consequence, the rocket exhaust stream functions as a suitable "gas plug" in the opening in order to prevent recirculation of the exhaust gases back into the chamber undergoing firing.

It is important to control the rocket exhaust gas stream so that the gas plug is effective to prevent recirculation of exhaust gases back into the chamber. Control of the rocket exhaust stream on a dynamic basis to develop the gas plug effect appears to be more effective for the intended purpose than the use of fixed structure such as baffles, valves, diverters or the like which oftentimes have the undesirable result of interfering with the direct exhaust gas stream in their attempt to control flow, limit reverse circulation, etc. My prior U.S. Pat. No. 4,683,798, the entire disclosure of which is incorporated by reference as though fully set forth herein, discloses hinged doors near the lower end of each missile storage chamber but spaced from the juncture with the common plenum chamber by a transition region which provides a smooth transition from a generally square cross-section chamber in which a missile is stored and launched to a round exit opening in the chamber which connects with the exhaust plenum. This enhances the gas plug effect and uses it to prevent recirculation of exhaust gases back into the chamber of the missile being fired.

My prior U.S. Pat. No. 4,686,884, the entire disclosure of which is incorporated by reference as though fully set forth herein, discloses an arrangement including sets of doors to close off missile storage chambers coupled to a common plenum chamber upon the firing of a missile in another chamber with the addition of pivotable deflector panels which are installed in transition sections between the missile storage and launch chambers proper and the common plenum chamber.

My following listed prior patents deal with related aspects of rocket exhaust plenum chambers coupled to a plurality of missile launch canisters and the principles of using rocket exhaust gas flow to close the aft doors of missile canisters not presently undergoing launch firing or maintaining such doors closed during the firing of a missile in another canister: U.S. Pat. Nos. 4,134,327, 4,173,919, 4,186,647, 4,324,167, and 4,373,420.

Other patents which may bear a more or less remote resemblance to presently used missile launcher canister closures are the Sherts U.S. Pat. No. 2,679,467 and the Wilson et al U.S. Pat. No. 4,498,261. Both of these patents disclosure pressure blowout safety closures comprising rupturable membranes or panels which are scored to develop predetermined failure lines. Clamshell shaped closures are disclosed in U.S. Pat. No. 1,130,609 of S. T. Jones and U.S. Pat. No. 2,956,582 of L. A. Pranter. U.S. Pat. No. 2,427,980 of Stinson et al discloses an accordion pleated sidewall for a volume defined by an opening aircraft control surface, such as a flap, so as to provide an automatic assist to the movement of the control surface by trapping air in the volume established by the opening flap. None of these patents relate to the novel aspects of my disclosed invention, as claimed.

Present missile launcher canister aft closures are designed to open along the diagonals of a rectilinear configuration under the influence of the rocket exhaust impingement which causes the aft closure to rupture. The aft closure has previously been scored so that, for example, four triangular petals are formed from the bursting of the aft closure. The petals are bent back by the missile exhaust toward the sill plate and may rest against the sill plate. The resulting opening allows the rocket exhaust to flow into the associated plenum chamber with a corresponding plenum pressure increase. However when the exhaust plume diameter is not sufficient to completely fill the cover opening, the area along the separation diagonals between the triangular petals, in the vicinity of the corners of the rectilinear configuration, allows the now-pressurized plenum gases to recirculate back into the canister. This recirculation can cause undesirable heat transfer and contamination to the missile and/or the canister.

After the missile flies out of the canister, exhaust gases begin to flow from the plenum into the empty canister. This gas flow causes pressure waves and shock waves to be propagated in the air inside the canister. The flow of gases also causes the petals of the aft closure to move to the closed position where they are supported by a petal support grid. It is during the launch interval, however, when the petals of the aft closure are opened without the "plug" of missile exhaust being sufficient to fill the aft opening that the need to close off the outer areas of the opening formed in the corners of the ruptured aft closure develops.

SUMMARY OF THE INVENTION

In brief, arrangements in accordance with the present invention comprise aft closure arrangements for multi-missile launch systems incorporating a plurality of launch cells exhausting into a common plenum. The construction of systems in which embodiments of the invention are installed is such that the minimum flow area for exhaust gases resides within the canister or cell from which the fired missile is being launched, rather than in the transition flow passages leading to the common exhaust plenum. This flow area is such that, during the missile traversal of the launch canister, the supersonic rocket exhaust flow cannot negotiate the minimum flow area without "choking". "Choking" occurs when the product of the flow density and velocity is less than the mass flow rate per unit flow area, as described by the Continuity Equation. At the onset of "choke" conditions, the velocity at the minimum flow area has a Mach number which is just equal to 1.0. For some distance upstream, the flow is subsonic with the recovery pressure more than twice the pressure downstream of the minimum flow area.

Such multi-missile launch cells involve rocket exhaust flow that expands to fill the designed channel area downstream of the rocket nozzle exit, even when opposed by the pressure which exists at or beyond the channel exit. It is desirable that such systems prevent back flow or recirculation of exhaust flow into the volume which is upstream of the rocket nozzle exit. The cross-sectional area of the rocket exhaust downstream of the rocket nozzle is equal to or greater than the nozzle exit and is constant or increasing in size as a function of distance downstream from the nozzle. Unfortunately, however, at least in the initial stages of the missile launch, the rocket nozzle has not progressed far enough from the aft closure to fill the entire area of the opening. Until the missile progresses far enough along the canister during flyout to permit expansion of the rocket exhaust to completely fill the aft opening, it is still possible for exhaust to recirculate back into the canister through the corners of the opening which are outside the exhaust plume. Arrangements in accordance with the present invention are specifically designed to prevent this recirculation of exhaust through the corner elements of the conventional aft closure during any normal or restrained missile firing in a Vertical Launcher System (VLS).

Particular embodiments of the invention comprise a plurality of convoluted fan structures placed along the bottom surface (the plenum side) of each diagonal segment of the aft closure. These fan structures are not connected at the center. They serve the purpose of preventing corner flow from circulating back into the canister by providing a barrier structure closing off the corners of the aft closure. In operation, during firing of a missile rocket, as the aft closure petals open under the influence of the rocket exhaust impingement on a top surface of the closure, the fan structures of the invention expand and close off the diagonal areas toward the corners. The central area of the aft closure opens to allow the exhaust to pass into the plenum. As the petals of the aft closure open further to accommodate the expanding cross-section of the rocket exhaust, the fan structures unfold to accommodate the enlarged exhaust opening. As the exhaust flow into the plenum pressurizes the plenum, the pressure on the underside of the exhaust closure acts on the bottom surface of the closure petals and fan structure, tending to close the petals so that an equilibrium position of the petals is continually achieved. Thus the arrangements in accordance with the present invention serve a dual function: not only do they block unwanted recirculation of exhaust gases from the plenum chamber back up into the canister through openings outside the rocket exhaust plume, but they augment the closing force on the closure petals which is developed by the pressure in the plenum chamber.

Under the preferred design, all of the exhaust flows through the fan/petal center opening and none of the plenum gas recirculates back into the canister, The more folds there are in the fan structure, the more the central flow area edges approach circular arcs. Various particular embodiments of the invention incorporate different numbers of pleats in the fan structure. A single pleat arrangement may be used, as well as having multiple pleats make up the fan structure, at each space between adjacent petals of the aft closure.

BRIEF DESCRIPTION OF THE DRAWINGS

A better understanding of the present invention may be realized from a consideration of the following detailed description, taken in conjunction with the accompanying drawings in which:

FIG. 3 is a schematic view of a portion of the arrangement of FIG. 1;

FIG. 4 is a schematic view corresponding somewhat to that jointly depicted by FIGS. 2A an 2B;

FIG. 5 is another schematic view corresponding to FIG. 3;

FIG. 6 is another schematic view corresponding to FIG. 4;

DESCRIPTION OF THE PREFERRED EMBODIMENTS

Figure 1:
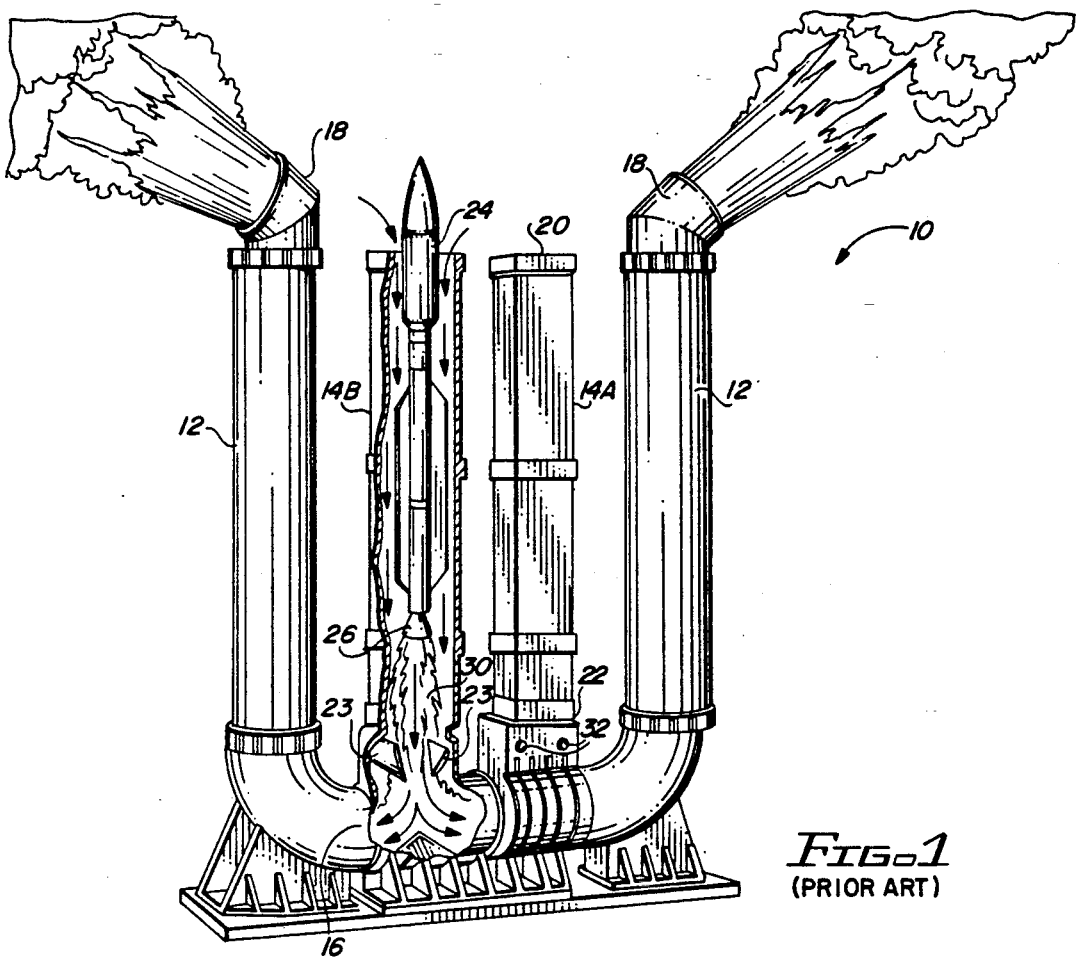
FIG. 1 (PRIOR ART)
FIG. 1 is a view, partially cutaway, of a shipboard missile launching installation.

FIG. 1 represents a typical shipboard installation which is a multi-purpose missile launching system firing missiles capable of engaging air, surface and underwater targets. The surrounding shipboard structure has been omitted from this drawing for clarity. In FIG. 1, a vertical launch system (VLS) 10 is shown comprising exhaust stacks 12 on opposite sides of a pair of canister launchers 14, all being connected at the bottom to a two-directional plenum chamber 16. The exhaust stacks 12 are provided with blast deflectors 18 at their upper terminations. The canister launcher 14A is shown with a frangible forward or upper cover 20, and a rear or aft cover 22 is indicated at the bottom of the launcher 14A.

Launcher 14B is shown partially broken away to illustrate a missile 24 with a rocket motor and aft rocket nozzle 26 in the process of being launched. A plume 30 is shown emanating from the bottom of the nozzle 26 and expanding in size with distance from the nozzle 26. The arrows entering the top of the canister 14B and passing downwardly alongside the missile and ultimately into the plenum 16 indicate air which is entrained by the exhaust from the rocket nozzle 26, accounting in part for the expansion in size of the plume 30.

The bottom closure of the canister 14 is shown comprising a pair of exhaust control doors 23 which, in this version of a prior art system, are used to prevent recirculation of exhaust gases from the plenum 16 into the chamber 14B. Control of the doors 23 opening velocity is effected by dampers such as those numbered 32 at the base of the canister 14A.

Figure 2A:
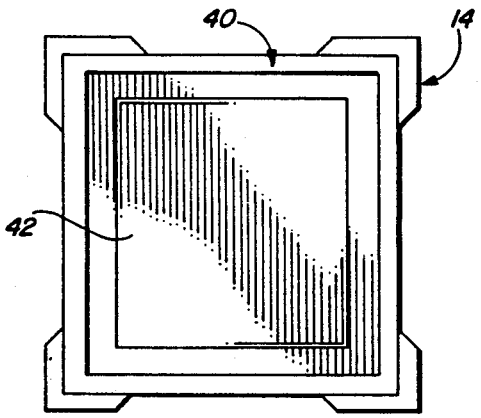
FIGS. 2A and 2B are bottom views looking up of a canister such as is shown in the system of FIG. 1.
Figure 2B:
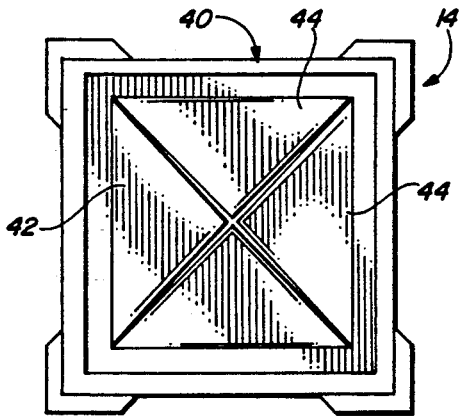

FIGS. 2A and 2B depict an alternative aft closure arrangement which is commonly used in place of the control doors 23 shown in the system 10 of FIG. 1. The aft closure 40 of these two figures is indicated as a solid plate 42 in FIG. 2A, as it exists prior to the firing of a missile rocket motor in an associated canister. The solid plate 42 of FIG. 2A is scored (the score lines are not visible) so that it will rupture when an associated missile is launched. In FIG. 2B, the rupture lines of the plate 42 are clearly apparent, the plate having ruptured with petals 44 opening in response to the impinging rocket exhaust and thereafter closing to the configuration shown in FIG. 2B after the missile has been launched.

The before and after stages of aft closures 40 are indicated in FIGS. 3 and 4, FIG. 4 being a view from the plenum side of the canister 14, taken along the lines 4—4 of FIG. 3, looking in the direction of the arrows. In FIG. 4, the score lines of the plate 42A are apparent for the end closure 40A of the canister 14A containing an unfired missile 24A. The missile 24B is undergoing launch and the exhaust of its rocket nozzle 26B is impinging on the plate 42B, forcing the petals 44B downwardly to define a central opening 46 through which the exhaust can pass into the plenum 16.

FIGS. 5 and 6 show the same situation as in FIGS. 3 and 4, except that the force vectors due to pressure within the plenum 16 are indicated by the arrows 48 with reverse flow of gases from the plenum 16 being indicated by the arrows 50.

In FIG. 6, the corner apertures 52B between adjacent petals 44B are shown outside the perimeter 54 of the rocket exhaust plume 30. It is through these corner openings 52B that the recirculation of exhaust gases, indicated by the arrows 50 in FIG. 5, can pass.

Figure 7A:
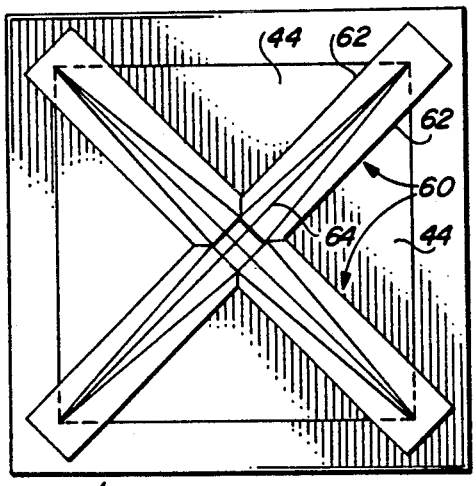
FIG. 7A is a schematic representation of one particular arrangement in accordance with the present arrangement, as viewed from the plenum side of a canister closure.
Figure 7B:
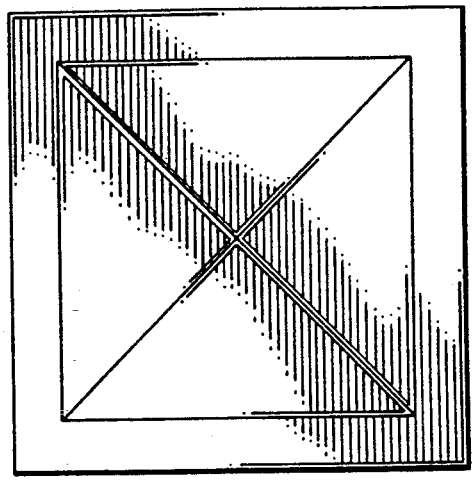
FIG. 7B is a view of the structure of FIG. 7A taken from the missile side of the canister closure.
Figure 8A:
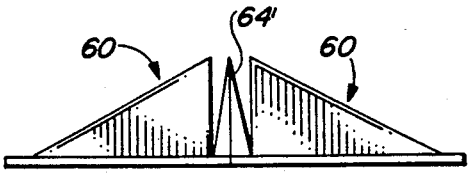
FIGS. 8A and 8B are schematic views broken out from FIG. 7A showing alternative embodiments of the present invention.
Figure 8B:
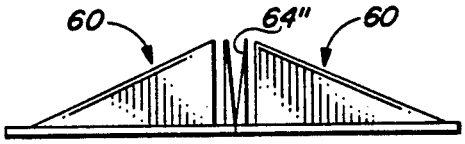

FIGS. 7A–8B illustrate particular embodiments of the present invention which are effective to block the corner openings 52 as the petals of an end closure are opened by impingement of rocket exhaust from an associated rocket motor undergoing launch or merely static firing. FIGS. 7A and 7B are, respectively, lower and upper views of an end closure 40 of the scored petal type, shown in the closed position. As seen in FIG. 7A, four convoluted fan structures 60 are shown, each being attached by side elements 62 to respective ones of adjacent petals 44. In FIGS. 8A and 8B, the fan structures are shown in side view for a single pleat (FIG. 8A) and for multiple pleats (FIG. 8B). Between the two side elements 62 (FIG. 7A) is a pleated or fan-folded arrangement 64. This is shown in the side sectional view of FIG. 8A as comprising a single pleat 64'. In the alternative embodiment illustrated in FIG. 8B, the fan-folded structure 64" comprises multiple pleats (in this case two).

Figure 9:
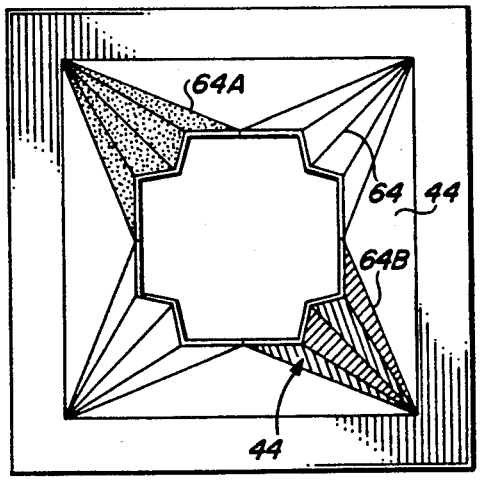
FIG. 9 is a view of the arrangement of FIG. 8B with the canister closure partly open.
Figure 10:
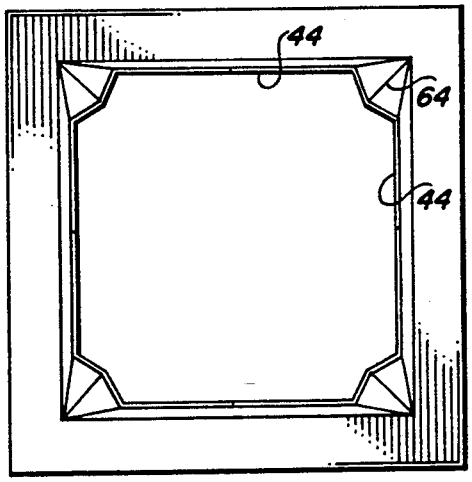
FIG. 10 is a view of the same structure with the canister closure elements fully opened.

As the end closure 40 is opened by impingement of rocket exhaust thereon, it moves to a partially open configuration, as shown in FIG. 9 and finally to a fully open configuration as shown in FIG. 10. It will be apparent from FIGS. 9 and 10 that the corners are filled by the fan-folded, multipleated structure 64, thus preventing the recirculation of exhaust gases which was possible with the end closure depicted in FIG. 6. Because these spaces between the petals re closed by the pleated structure 64, the closing force after flyout of the launched missile is enhanced, relative to the closing force which would be applied to the petals without the presence of the fan-folded structure 64. Thus, arrangements in accordance with the present invention beneficially close off the corner openings of the prior art aft closures, thereby preventing recirculation of exhaust gases into the canister or missile cell for the pressurized plenum and augmenting the closure force effective to close the petal closure after the missile is launched.

The segments of the fan structure 64 can be folds or creases, or if desired they maybe mechanically hinged. Furthermore, they may be composed of rigid or flexible material, as desired. Where necessary, the fan structure can be protected from rocket exhaust or plenum gas heat transfer by coating the surface with a suitable insulating material or by forming the fan structure 64 from an ablative material. The stippled appearance of the segments of the fan structure 64A in FIG. 9 is intended to represent a surface coating of insulating material. The hatched appearance of the segments of the fan structure 64B of FIG. 9 is intended to indicate fabrication of the structure from an ablative material, such a fiberglass, woven or wound boron fiber, or the like.

Although there have been described hereinabove various specific arrangements of an apparatus for limiting recirculation of rocket exhaust gases during missile launch in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. Apparatus for limiting recirculation of rocket exhaust gases from an associated plenum chamber into a missile canister through gaps in an aft closure of the canister situated radially outward of the missile rocket exhaust plume, the aft closure having a plurality of pivotable portions which are movable in response to impinging rocket exhaust gases, said apparatus comprising:

a folded fan structure extending between adjacent pivotable portions of the aft closure and having at least one folded segment capable of unfolding to expand in extent as the aft closure portions pivot toward an open position, said fan structure extending across said gaps to block the openings therein.

2. The apparatus of claim 1 wherein the said at least one segment is coated with an insulating material along the surface facing the rocket exhaust.

3. The apparatus of claim 1 wherein said at least one segment is formed of ablative material.

4. The apparatus of claim 1 comprising additional folded fan structures extending between other pairs of adjacent pivotable portions of the aft closure, all of said fan structures being installed to define an opening near the center of the aft closure and to extend to the corner junctures of respective adjacent pivotable members.

5. The apparatus of claim 1 wherein said at least one segment comprises a plurality of segments defining pleats in the folded fan structure.

6. The apparatus of claim 5 wherein said fan structure comprises at least a pair of side elements attached, respectively, to adjacent pivotable members of the aft closure.

7. In combination, a plurality of missile canisters each having an aft closure comprising a rupturable member scored to delineate a plurality of outwardly opening petal elements;

a plenum chamber coupled to said missile canisters for carrying rocket exhaust therefrom to a safe dispersal region; and fan-folded means fastened to adjacent petal elements along the score lines of said aft closures, said fan-folded means being openable with said petal elements to cover spaces between said opening elements in order to prevent reverse circulation of exhaust gases from the plenum chamber into the corresponding canister through the opening aft closure.

8. In a missile launching system having a plurality of missile canister coupled to a common exhaust plenum chamber for carrying rocket exhaust to safe dispersal region, each canister having an aft closure formed of a plurality of pivotable closure portions which are movable in response to impinging rocket exhaust, said pivotable portions when pivoted away from the closed position defining a plurality of gaps in corners portions of the aft closure which are radially outward of the rocket exhaust plume, the improvement comprising:

fan-folded means secured between adjacent pivotable portions and extending across said gaps, said fan-folded means being openable with the pivotable portions to cover said gaps and prevent reverse circulation of exhaust gases from the plenum chamber into the corresponding canister.

9. The improvement of claim 8 wherein said fan-folded means include a plurality of individual segment extending between the pivotable portions for increasing the effective area of the aft closure when in the open position to augment the force applied to the under side of aft closure by pressurized gases in the plenum chamber, thereby serving to close the pivotable portions of the aft closure after a missile is launched.

10. The improvement of claim 8 wherein said fan-folded means include a pair of opposed fastening means at opposite sides thereof for attaching the fan-folded means to the adjacent pivotable portions along a separation line between said adjacent portions.

11. The improvement of claim 8 wherein said fan-folded means comprises a plurality of individual fan structures, one for each separation line between adjacent pivotable portions of the aft closure, said structures being spaced from each other at the center of the aft closure to define an opening which is enlargeable as the pivotable portions are moved outwardly by impinging rocket exhaust so as to permit the rocket exhaust plume to extend into the plenum chamber.

* * * * *